US012577792B2

(12) United States Patent
Cipriani

(10) Patent No.: US 12,577,792 B2
(45) Date of Patent: Mar. 17, 2026

(54) SUPPORT SYSTEM FOR RAISED FLOORS

(71) Applicant: Dakota Group S.a.s. di Zeno Cipriani & C., Affi (IT)

(72) Inventor: Zeno Cipriani, Affi (IT)

(73) Assignee: DAKOTA GROUP S.A.S. DI ZENO CIPRIANI & C., Affri (IT)

( * ) Notice: Subject to any disclaimer, the term of this patent is extended or adjusted under 35 U.S.C. 154(b) by 324 days.

(21) Appl. No.: 18/258,760

(22) PCT Filed: Dec. 20, 2021

(86) PCT No.: PCT/IB2021/062009
§ 371 (c)(1),
(2) Date: Jun. 21, 2023

(87) PCT Pub. No.: WO2022/137073
PCT Pub. Date: Jun. 30, 2022

(65) Prior Publication Data
US 2024/0044150 A1 Feb. 8, 2024

(30) Foreign Application Priority Data
Dec. 21, 2020 (IT) ..... 102020000031697

(51) Int. Cl.
*E04F 15/02* (2006.01)
*E04F 15/024* (2006.01)

(52) U.S. Cl.
CPC ..... *E04F 15/0247* (2013.01)

(58) Field of Classification Search
CPC ..... E04F 15/0247; E04F 15/02183; E04F 15/02482; E04F 15/02447
See application file for complete search history.

(56) References Cited

U.S. PATENT DOCUMENTS

| | | | | |
|---|---|---|---|---|
| 5,442,882 | A | 8/1995 | Repasky | |
| 2004/0206039 | A1 | 10/2004 | Carlsson | |
| 2017/0152635 | A1* | 6/2017 | Tabibnia | E04F 15/02482 |

FOREIGN PATENT DOCUMENTS

| | | | | |
|---|---|---|---|---|
| CH | 680676 | A5 | 10/1992 | |
| EP | 3358102 | A1 | 8/2018 | |
| FR | 3054577 | B1 * | 8/2019 | E04F 15/0247 |
| WO | 9923327 | A1 | 5/1999 | |
| WO | 2020046227 | A2 | 3/2020 | |

OTHER PUBLICATIONS

International Search Report and Written Opinion of the ISA for PCT/IB2021/062009 mailed Feb. 4, 2022, 13 pages.

* cited by examiner

*Primary Examiner* — Patrick J Maestri
(74) *Attorney, Agent, or Firm* — NIXON & VANDERHYE

(57) ABSTRACT

Disclosed is a support system for the construction of raised floors with a walking surface spaced apart from a base, a lower rotor resting on the base, and an upper rotor resting above the lower rotor. The lower rotor has a spiral profile on which an upper sloping plane is defined, and the upper rotor has a spiral element on which a lower sloping plane is defined. The upper sloping plane is leant on the lower sloping plane so that, when the upper rotor rotates relative to the lower rotor, the upper rotor is raised or lowered relative to the lower rotor depending on the direction of rotation.

20 Claims, 4 Drawing Sheets

SUPPORT SYSTEM FOR RAISED FLOORS

CROSS-REFERENCE TO RELATED APPLICATIONS

This application is the U.S. national phase of International Application No. PCT/IB2021/062009 filed Dec. 20, 2021 which designated the U.S. and claims priority to IT 102020000031697 filed Dec. 21, 2020, the entire contents of each of which are hereby incorporated by reference.

The present invention relates generally to a support system for raised floors. In particular, it relates to a support system for raised floors which is quickly and easily adjustable in height.

As is well known, raised floors are suspended flooring systems in which the walking surface rests on a structure raised above the ground, usually made of suspended modular elements. Between the bottom and the walking surface there is a technical compartment that can be inspected, for example for the passage of cables.

The floor level must be placed at a height above the floor, which may vary from case to case, depending on the different requirements of the environment in which the floor is being laid and the dimensions of the technical compartment to be obtained.

Consequently, it is often necessary to vary the height of the flooring from site to site.

For this purpose, adjustable support systems have been introduced that allow the height of the floor to be varied from the bottom according to the different needs of the individual construction site.

However, these adjustable support systems are impractical, as they take time to adjust.

In addition, such support systems do not allow rapid identification of the height to which the support has been set.

The aim of the invention is, therefore, to realise a support system for raised floors which overcomes the problems of the known technique.

A further scope of the invention is to provide a raised floor support system that is adjustable in a practical and fast manner.

A further purpose of the invention is to provide a raised floor support system that allows immediate identification of the height to which the support system itself has been adjusted.

According to the invention, all purposes and more are achieved by a support system for creating raised floors with a walking surface spaced apart from a base, comprising a lower rotor capable of resting on the base, and an upper rotor capable of resting above the lower rotor.

In particular, the support system is characterised in that the lower rotor comprises a spiral profile on which an upper inclined plane is defined, and the upper rotor comprises a spiral element on which a lower inclined plane is defined.

The upper inclined plane rests on the lower inclined plane, so that as the upper rotor rotates relative to the lower rotor, the upper rotor is raised or lowered relative to the lower rotor depending on the direction of rotation.

Thanks to this conformation of the two rotors, a relative rotation of the two rotors is sufficient to vary the height, i.e. the thickness created by the two rotors together on top of each other.

Advantageously, the bottom rotor may comprise a central cylindrical body that fits into a central hole in the top rotor, thus ensuring perfect coaxiality of the bottom rotor with the top rotor.

In addition, the lower rotor may comprise a protruding element suitable for being grasped to ensure an optimal grip of the lower rotor itself.

An end hole may be defined in the protruding element into which a user may insert their finger to improve grip.

Similarly, the upper rotor may comprise protruding bodies to provide a grip for the upper rotor itself.

Advantageously, the protruding bodies may be angularly equidistant from each other, so as to improve grip and rotation measurement for the user.

Furthermore, in order to have a clear idea of the height defined once the two rotors have been rotated together, there may be markings on the upper rotor identifying various measures of the height obtainable from the upper rotor with respect to the lower rotor, and a point may protrude radially from the lower rotor to identify the marking on the upper rotor corresponding to the actual height achieved.

Advantageously, the support system may comprise a connecting plate arranged to rest on the upper rotor and to allow the arrangement of the elements making up the walking surface.

Further, the support system may comprise an extension plate arranged between the base plate and the lower rotor, so as to raise the lower rotor by a height equal to the thickness of the extension plate.

Advantageously, through-holes for draining water or other liquids may be provided in the lower rotor and/or the upper rotor.

Further features and details of the invention may be better understood from the following description, given by way of non-limiting example, as well as from the accompanying drawing plates, wherein.

Figure 1:
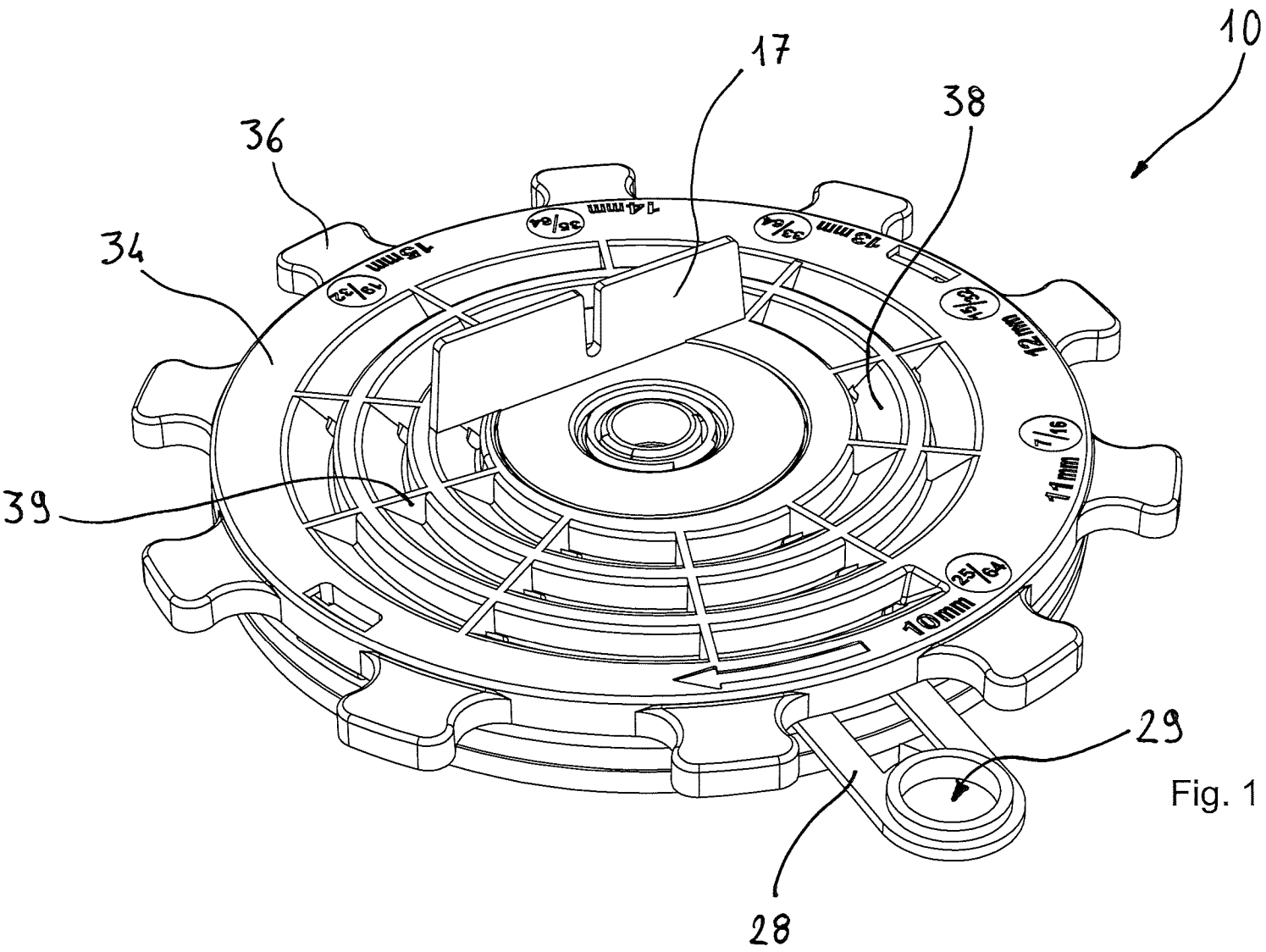
FIG. 1 is an axonometric view of a support system according to the invention.
Figure 2:
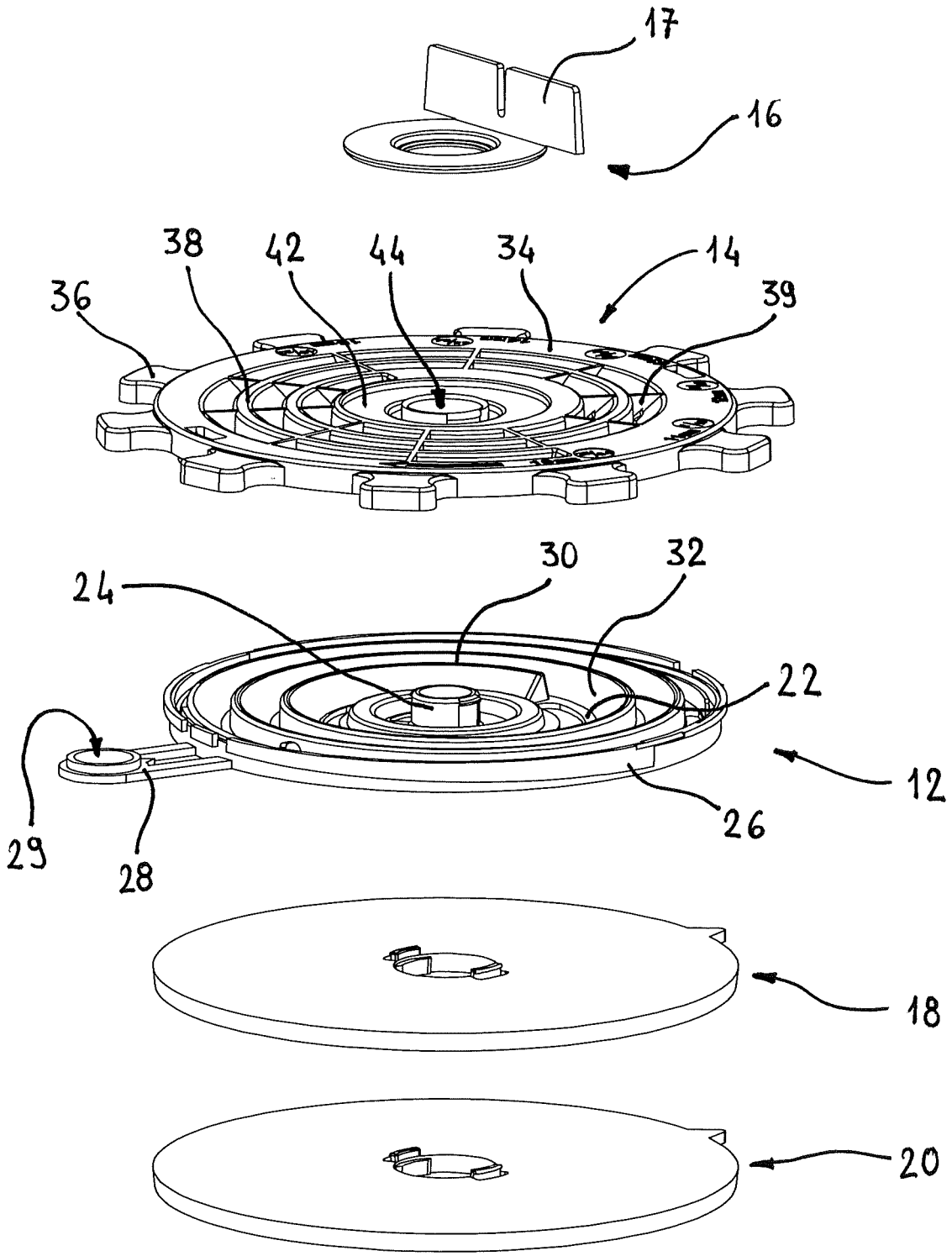
FIG. 2 is an exploded axonometric view of the support system of FIG. 1.
Figure 4:
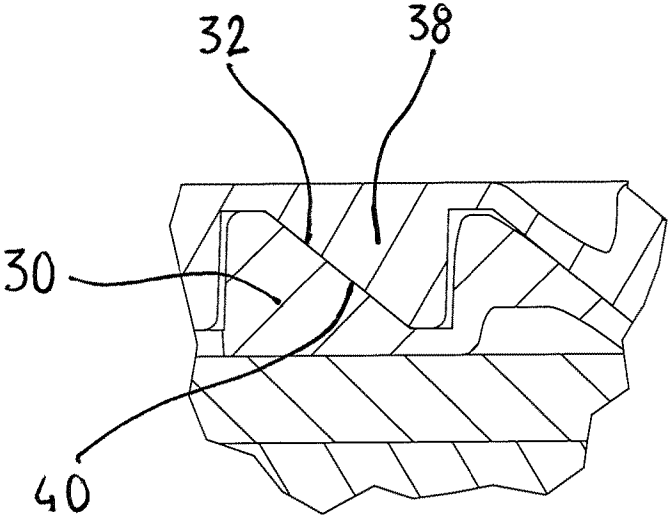
FIG. 4 is a view of a detail of FIG. 3, indicated by E.

With reference to the appended figures, in particular FIGS. 1 to 3, 10 indicates a support system according to the invention for creating raised floors, so as to arrange a walking surface formed by wooden tiles or battens at a height from the base.

According to the embodiment illustrated herein, the support system 10 comprises:

- a lower rotor 12
- an upper rotor 14 suitable for being supported above the lower rotor 12;
- a connection plate 16, supported at the top of the upper rotor 14;
- a first extension plate 18, positioned inferiorly to the lower rotor 12;
- a second extension plate 20, arranged inferiorly to the first extension plate 18 and suitable for resting on a reference ground.

The lower rotor 12 comprises a base disc 22 defined perimeterally by an edge 26 and having a central cylindrical body 24.

From the base disc 22 radially protrudes a projecting element 28 in which an end hole 29 is formed. A point 31 protrudes from the opposite side of the protruding element 28.

From the base disc 22 there protrudes vertically upwards a spiral profile 30 on which an upper inclined plane 32 is defined.

In the central part and in the peripheral part of the base disc 22, arcuate openings 23 are obtained through which water may be discharged.

The upper rotor 14 comprises an outer ring 34 from which radially projecting bodies 36 protrude at an angle equidistant from each other.

From the outer ring 34 starts a spiral element 38 on which a lower inclined plane 40 is defined.

The upper rotor 14 centrally comprises an annular support 42 with a central hole 44.

On the annular support 42 of the upper rotor 14 rests the connecting plate 16 which includes a vertical fin 17 and is suitable to allow coupling with tiles or wooden boards or with a support frame.

The spiral element 38 is also rigidly fixed to the outer ring 34 and the annular support 42 by means of radial elements 39.

In the lower portion of the spiral element 38, in correspondence with the radial elements 39, holes 41 are provided for the passage of any water.

The upper rotor 14 is supported on top of the lower rotor 12, so that the central cylindrical body 24 fits into the central hole 44.

Figure 3:
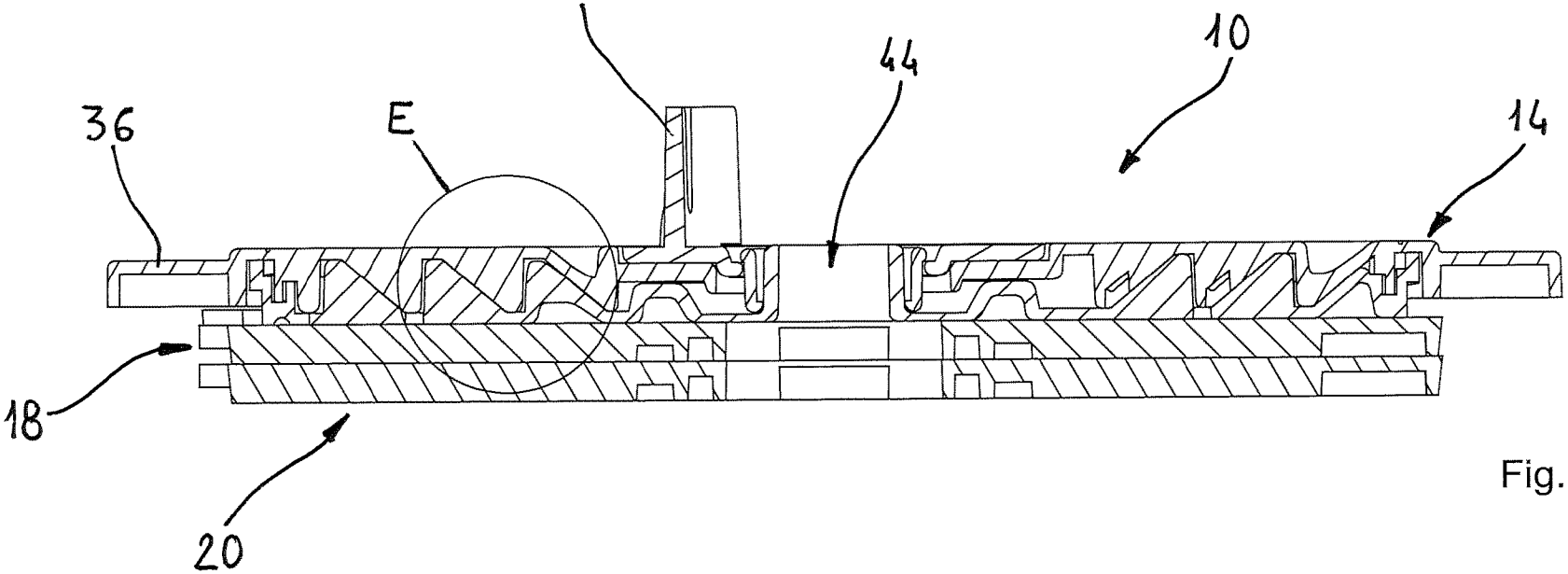
FIG. 3 is a side sectional view of the support system of FIG. 1.
Figure 5:
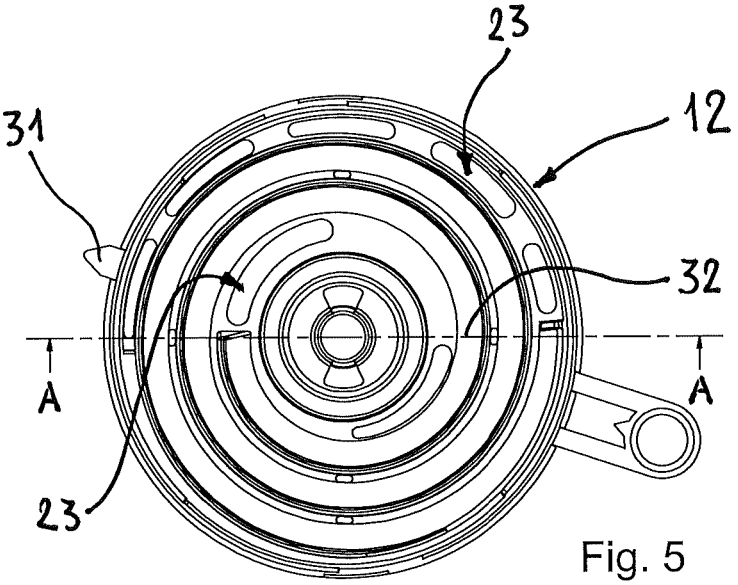
FIG. 5 is a top view of a first element of the FIG. 1 support system.
Figure 6:
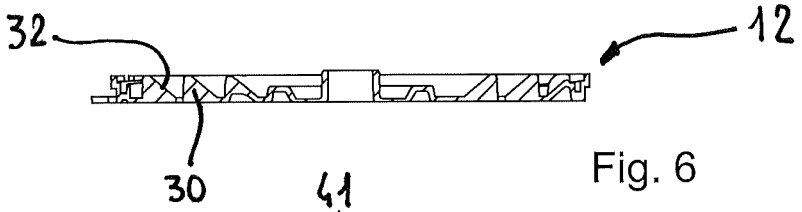
FIG. 6 is a side view of the element of FIG. 5 in section in the plane A-A.
Figure 7:
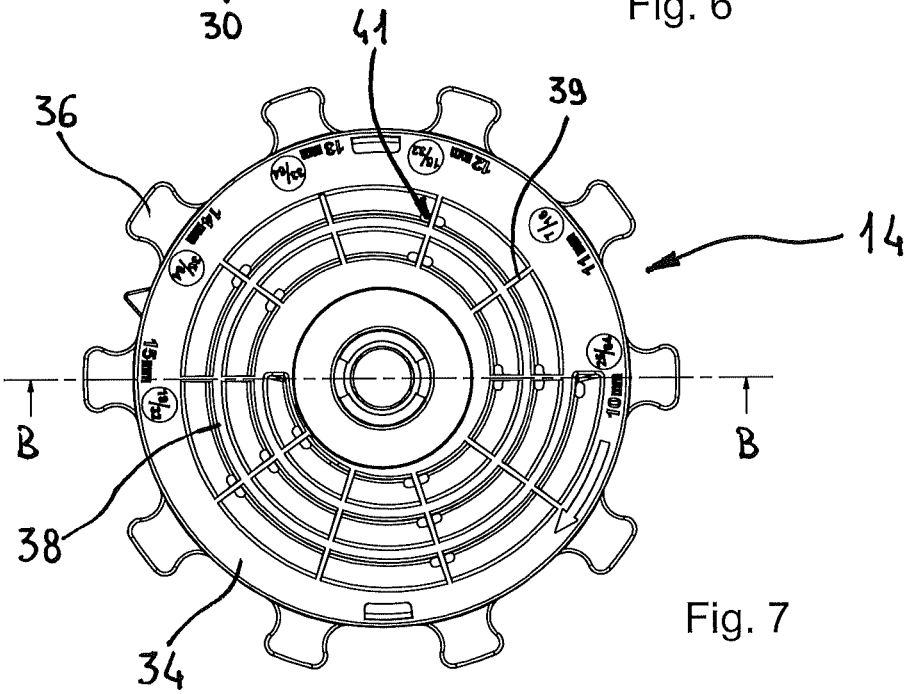
FIG. 7 is a top view of a second element of the support system of FIG. 1.
Figure 8:
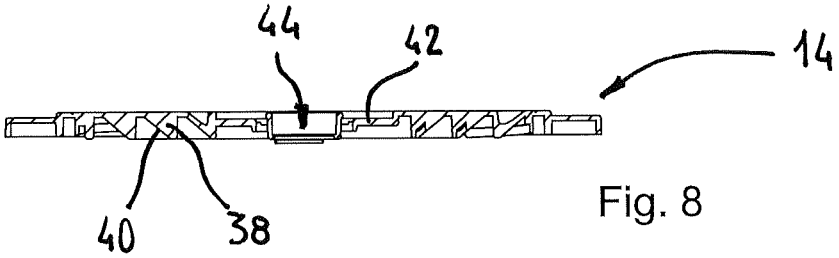
FIG. 8 is a side view of the element of FIG. 7 in section according to the plane B-B.

Furthermore, the lower inclined plane 40 of the spiral element 38 of the upper rotor 14 rests on the upper inclined plane 32 of the spiral profile 30 of the lower rotor 12, as illustrated by FIG. 3.

By rotating the upper rotor 14 relative to the lower rotor 12 in a clockwise direction, the lower inclined plane 40 of the spiral element 38 slides on the upper inclined plane 32 of the spiral profile 30 and thus forces the upper rotor 14 to rise relative to the lower rotor 12.

The rotation of the two rotors 12, 14 is easily carried out by an operator who can, with one hand, lock the lower rotor 12 in position, grasping it by means of the protruding element 28, inserting a finger in the relative terminal hole 29, and with the other hand grasp and turn the upper rotor 14 by gripping the protruding bodies 36.

On the upper rotor 14, specifically on the outer ring 34, there are markings identifying various measures of the height to which the upper rotor 14 is brought in relation to the lower rotor 12.

The height actually reached is indicated by the tip 31 of the lower rotor 12 in correspondence to the corresponding inscription shown on the upper rotor 14.

The first extension plate 18 and the second extension plate 20 are optional and are used to raise the lower rotor 12 and thus the upper rotor 14 to a greater height.

A different element can be used as an alternative to the connecting plate 16, depending on the type of flooring to be installed.

There are snap-on mechanisms for coupling the lower rotor 12 to the upper rotor 14, the connecting plate 16 to the upper rotor 14, the first extension plate 18 to the lower rotor 12, and between the extension plates 18, 20.

Further variants and embodiments other than those illustrated above are possible and are to be considered within the scope of protection defined by the appended claims.

For example, the elements for gripping the two rotors can be of different conformation, as can the indications of the heights reached.

The invention claimed is:

1. Support system for the construction of raised floors with a walking surface spaced from a base, comprising:

a lower rotor suitable for resting on the base plate;

an upper rotor suitable for being placed on the lower rotor wherein the lower rotor comprises a spiral profile on which an upper sloping plane is defined, and the upper rotor comprises a spiral element on which a lower sloping plane is defined; the upper sloping plane being leant on the lower sloping plane, so that, when the upper rotor rotates relative to the lower rotor, the upper rotor is raised or lowered relative to the lower rotor depending on the direction of rotation, wherein the lower rotor comprises a protruding element suitable for being grabbed in order to ensure a grip of the lower rotor itself, and wherein in the protruding element an end hole is defined wherein a user can insert his finger to improve the grip.

2. The support system according to claim 1, wherein the lower rotor comprises a central cylindrical body suitable for being inserted in a central hole obtained in the upper rotor, in order to ensure perfect coaxiality of the lower rotor with the upper rotor.

3. The support system according to claim 1, wherein the upper rotor comprises protruding bodies to improve the grip of the upper rotor itself.

4. The support system according to claim 3, wherein the projecting bodies are angularly equidistant from each other.

5. The support system according to claim 1, wherein on the upper rotor there are markings identifying various measurements of the height obtainable from the upper rotor in relation to the lower rotor, and from the lower rotor a point protrudes radially to identify the marking on the upper rotor corresponding to the actual height achieved.

6. The support system according to claim 1, wherein a connector plate is included, which is placed on the upper rotor and allows for the arrangement of the floor elements which form the walking surface.

7. The support system according to claim 1, wherein an extension plate is included, suitable for being placed between the base and the lower rotor so as to raise the lower rotor by a height equal to the thickness of the extension plate.

8. The support system according to claim 1, wherein in the lower rotor and/or in the upper rotor through-holes are provided for the drainage of water or other liquids.

9. The support system according to claim 2, wherein the upper rotor comprises protruding bodies to improve the grip of the upper rotor itself.

10. The support system according to claim 2, wherein on the upper rotor there are markings identifying various measurements of the height obtainable from the upper rotor in relation to the lower rotor, and from the lower rotor a point protrudes radially to identify the marking on the upper rotor corresponding to the actual height achieved.

11. The support system according to claim 3, wherein on the upper rotor there are markings identifying various measurements of the height obtainable from the upper rotor in relation to the lower rotor, and from the lower rotor a point protrudes radially to identify the marking on the upper rotor corresponding to the actual height achieved.

12. The support system according to claim 4, wherein on the upper rotor there are markings identifying various measurements of the height obtainable from the upper rotor in relation to the lower rotor, and from the lower rotor a point protrudes radially to identify the marking on the upper rotor corresponding to the actual height achieved.

13. The support system according to claim 2, wherein a connector plate is included, which is placed on the upper rotor and allows for the arrangement of the floor elements which form the walking surface.

14. Support system for the construction of raised floors with a walking surface spaced from a base, comprising:

a lower rotor suitable for resting on the base plate;

an upper rotor suitable for being placed on the lower rotor wherein the lower rotor comprises a spiral profile on which an upper sloping plane is defined, and the upper rotor comprises a spiral element on which a lower sloping plane is defined; the upper sloping plane being leant on the lower sloping plane, so that, when the upper rotor rotates relative to the lower rotor, the upper rotor is raised or lowered relative to the lower rotor depending on the direction of rotation, and wherein on the upper rotor there are markings identifying various measurements of the height obtainable from the upper rotor in relation to the lower rotor, and from the lower rotor a point protrudes radially to identify the marking on the upper rotor corresponding to the actual height achieved.

15. The support system according to claim 14, wherein the lower rotor comprises a central cylindrical body suitable for being inserted in a central hole obtained in the upper rotor, in order to ensure perfect coaxiality of the lower rotor with the upper rotor.

16. The support system according to claim 14, wherein the lower rotor comprises a protruding element suitable for being grabbed in order to ensure a grip of the lower rotor itself.

17. The support system according to claim 16, wherein in the protruding element an end hole is defined wherein a user can insert his finger to improve the grip.

18. The support system according to claim 14, wherein the upper rotor comprises protruding bodies to improve a grip of the upper rotor itself.

19. The support system according to claim 18, wherein the projecting bodies are angularly equidistant from each other.

20. Support system for the construction of raised floors with a walking surface spaced from a base, comprising:

a lower rotor suitable for resting on the base plate;

an upper rotor suitable for being placed on the lower rotor wherein the lower rotor comprises a spiral profile on which an upper sloping plane is defined, and the upper rotor comprises a spiral element on which a lower sloping plane is defined; the upper sloping plane being leant on the lower sloping plane, so that, when the upper rotor rotates relative to the lower rotor, the upper rotor is raised or lowered relative to the lower rotor depending on the direction of rotation, wherein the lower rotor comprises a protruding element suitable for being grabbed in order to ensure a grip of the lower rotor itself, and wherein on the upper rotor there are markings identifying various measurements of the height obtainable from the upper rotor in relation to the lower rotor, and from the lower rotor a point protrudes radially to identify the marking on the upper rotor corresponding to the actual height achieved.

* * * * *